United States Patent [19]

Bailey

[11] 4,336,840

[45] Jun. 29, 1982

[54] DOUBLE CYLINDER SYSTEM

[75] Inventor: Thomas F. Bailey, Houston, Tex.

[73] Assignee: Hughes Tool Company, Houston, Tex.

[21] Appl. No.: 213,871

[22] Filed: Dec. 8, 1980

Related U.S. Application Data

[62] Division of Ser. No. 913,117, Jun. 6, 1978, Pat. No. 4,249,600.

[51] Int. Cl.[3] ..... E21B 15/00; E21B 19/08; E21B 19/22

[52] U.S. Cl. ..... 166/77; 52/69; 52/117; 91/167 R; 92/117 A; 173/28; 173/152; 254/93 VA

[58] Field of Search ..... 166/77, 71, 72, 75 R; 254/93 R, 93 VA; 92/66, 146, 117 A; 91/167 R; 175/162, 103, 203; 173/28, 152

[56] References Cited

U.S. PATENT DOCUMENTS

| | | | |
|---|---|---|---|
| 2,126,933 | 8/1938 | Stone et al. | 166/77 |
| 2,502,895 | 4/1950 | Shaffer | 254/93 R |
| 2,595,401 | 5/1952 | Moon | 175/203 X |
| 2,821,264 | 1/1958 | Ulinski | 92/146 X |
| 2,930,582 | 3/1960 | Foster | 254/93 R |
| 3,003,746 | 10/1961 | Gridley | 254/93 R X |
| 3,026,950 | 3/1962 | Johnson | 173/28 X |
| 3,250,182 | 5/1966 | Nansel | 91/167 |
| 3,841,407 | 10/1974 | Bozeman | 166/77 X |
| 3,978,768 | 9/1976 | Ringkamp | 96/66 X |

*Primary Examiner*—Stephen J. Novosad

*Attorney, Agent, or Firm*—Robert A. Felsman; Charles D. Gunter, Jr.

[57] ABSTRACT

Disclosed is a system including two or more fluid pressure piston-and-cylinder assemblies. The cylinders are linked in pairs so that retraction of both piston rods reduces the length of the pair of assemblies to the length of a single assembly. Operation of both pistons in a pair provides an effective stroke twice the length of a single assembly stroke. In a particular embodiment, a double cylinder system is used as a pickup system for elevating equipment along a mast in a well workover rig.

2 Claims, 12 Drawing Figures

DOUBLE CYLINDER SYSTEM

This is a division of application Ser. No. 913,117, filed June 6, 1978 now U.S. Pat. No. 4,249,600.

BACKGROUND OF THE INVENTION

1. Field of the Invention

The present invention pertains to fluid-pressure operable mechanical systems. More particularly, the present invention relates to piston-and-cylinder assemblies, and may be used with advantage, for example, in applications where relatively extended stroke length is required in combination with limited distance storage requirements.

2. Description of the Prior Art

Fluid pressure piston-cylinder assemblies are known for use in maneuvering various forms of equipment, and particularly for manipulating mobile apparatus used in working on wells. Thus, for example, masts may be raised or lowered on drilling rigs by way of fluid pressure cylinder assemblies.

Coiled tubing systems for working on wells are known to utilize piston-cylinder assemblies for elevating the injector head of such a system to selected positions along a mast. Such well working systems are discussed in detail in a copending U.S. patent application Ser. No. 913,118 filed June 6, 1978, assigned to the same assignee as the present case, and now U.S. Pat. No. 4,265,304, wherein improvements in coiled tubing systems are disclosed.

In prior art coiled tubing systems, a single piston-cylinder assembly is mounted along each leg of a two legged mast. The piston rods extend down the mast to support the injector head. By appropriate control of the fluid pressure applied to the cylinders, the injector head may be selectively raised or lowered along the mast.

Such masts and associated equipment may be mounted on a truck or barge. In the case of such mobile systems, the mast may be folded, for example, to achieve an acceptable road clearance profile for transportation purposes. Then, the injector head is either tilted with the folded portion of the mast as in the prior art, or is first lowered below the piston of the mast hinge assemblies as disclosed in the aforementioned copending application. However, in order to provide the increased range of movement along the mast required for the injector head that may be so lowered below the mast hinge point, conventional piston-cylinder assemblies would have to be increased in both cylinder and piston rod length.

SUMMARY OF THE INVENTION

The present invention provides a double cylinder, fluid-pressure operated system. A pair of cylinders are joined together with their respective piston rods extendable in opposite directions. Each piston rod may be individually extended or retracted. An alternate form of operation of the double cylinder system involves linking the fluid pressure communication lines leading to the two cylinders so that the piston rods may be operated simultaneously and in combination. Such combined operation may be such that the piston rods extend simultaneously and retract simultaneously, or such that one piston rod extends while the other retracts.

The paired cylinders may be joined with a second pair of cylinders mutually linked in similar fashion. The fluid pressure communication lines leading to the two pairs of cylinders may also be joined so that each cylinder pair extends or retracts piston rods at the same time and in the same general direction.

Such a pair of cylinders may be mounted for movement along each leg of a two-legged mast used, for example, in a coiled tubing ring. The cylinder pairs may be joined by at least one cross-member so that all the cylinders are moved as a unit. The entire double cylinder system may be suspended from the mast at a point near the top of the mast by a piston rod extending generally upwardly from each cylinder pair. The downwardly extending piston rods may be lowered and joined to the injector head, or a carriage supporting the injector head. Operation of the double cylinder system moves the injector head to selected positions along the mast.

The combination of piston rods extendable in either direction from a floating double cylinder assembly provides a stroke length twice that of a conventional piston-cylinder assembly with the same cylinder length. Thus, the range of movement of the injector head in the referenced copending application may be increased without increasing the length of any one cylinder or piston rod. The injector head may be readily lowered below the mast hinge point as well as raised, say, two-thirds the length of the mast with the use of a double cylinder system.

To fold the mast, the injector head may be lowered below the mast hinge joint and the lower piston rods disengaged from the injector head carriage. The piston rods are all then retracted, raising the cylinders to the top of the mast, which is then tilted as desired.

The present invention thus provides a convenient means for practicing the aforementioned improvement in coiled tubing systems involving the lowering of the injector head to the base of the mast. The mast may then be folded without tilting the injector head, which is also then more accessible for servicing purposes.

DESCRIPTION OF PREFERRED EMBODIMENTS

Figure 1:
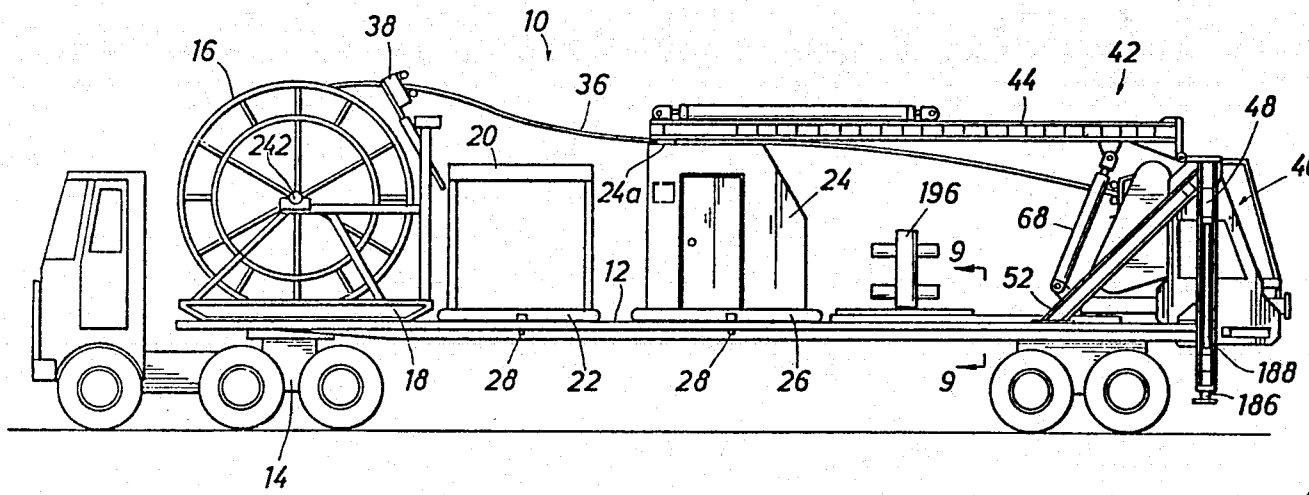
FIG. 1 is a side elevation of a coiled tubing system, utilizing the present invention, with the mast folded.
Figure 2:
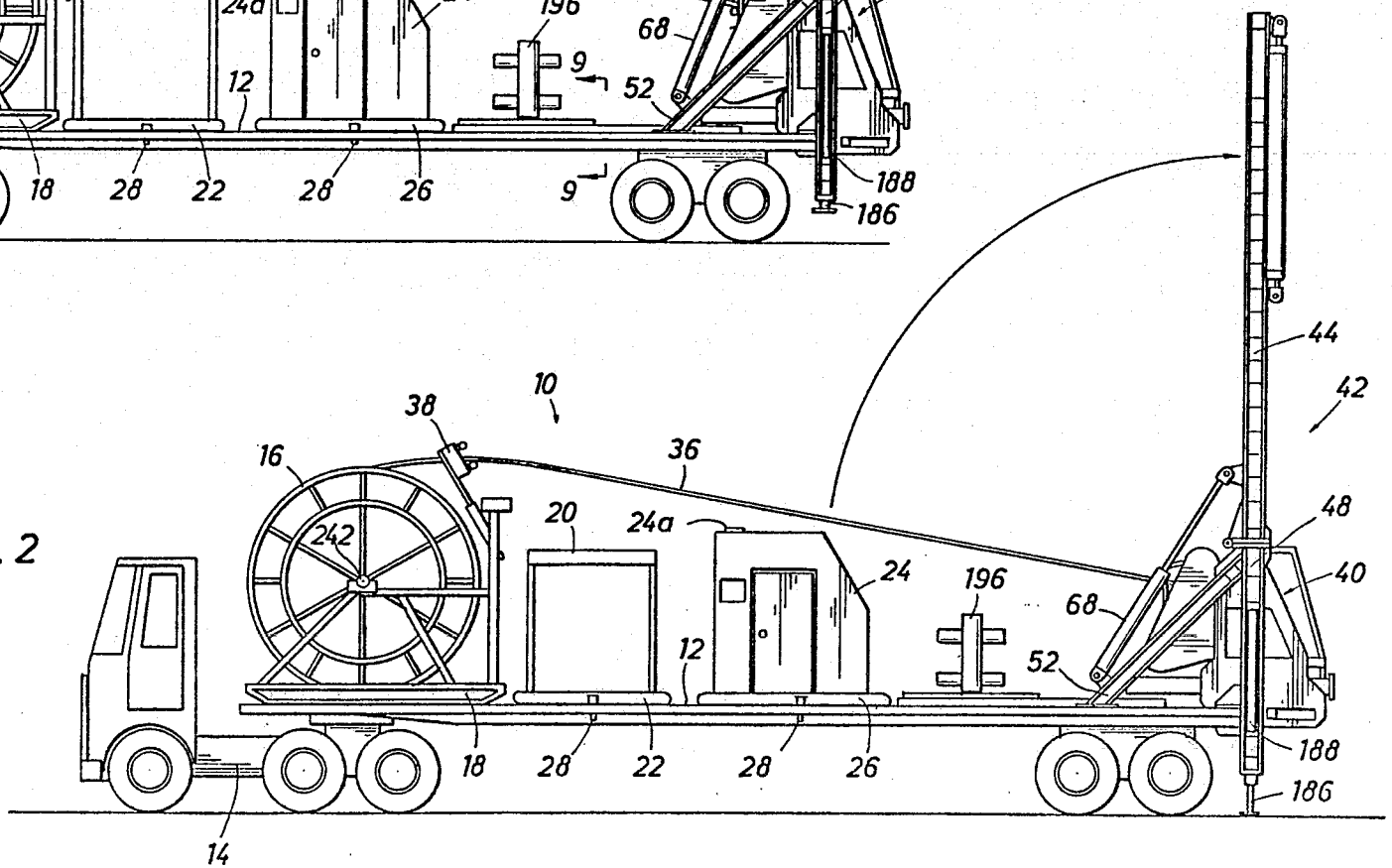
FIG. 2 is a view similar to FIG. 1, but with the mast erect.

A coiled tubing system including double cylinder apparatus according to the present invention is shown generally at 10 in FIGS. 1 and 2, mounted on the flatbed 12 of a trailer truck 14. While the improved system of the present invention may be utilized in a variety of applications, including stationery as well as mobile assemblies, and such mobile arrangements may take several forms including barge mounts or unitized carrier mounts, a trailer mounted coiled tubing application is shown and discussed herein by way of illustration rather than limitation.

The flatbed 12 supports a tubing reel assembly 16 mounted on a skid 18, a power unit 20 mounted on a skid 22, and a control house 24 mounted on a skid 26. The control house 24 includes most or all of the controls necessary for operating the various hydraulic and pneumatic systems employed with the coiled tubing apparatus, and is otherwise conventional. The power unit 20 includes the necessary power means used in operating the coiled tubing apparatus, including motors, a pneumatic compressor, and a hydraulic pump.

Figure 12:
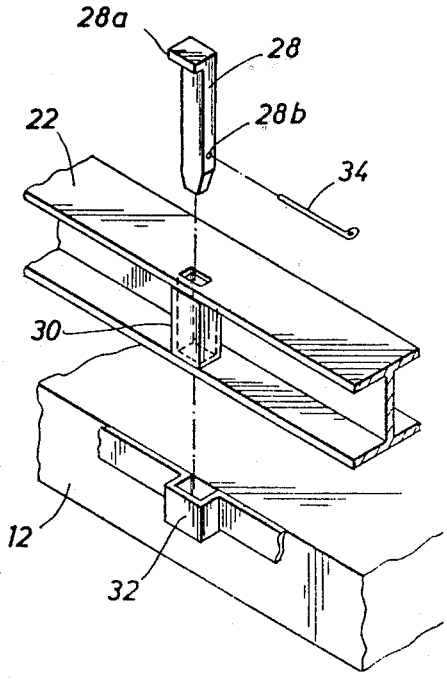
FIG. 12 is a fragmentary exploded view in perspective illustrating the manner of pinnning equipment skids to the truck bed.

Both the power unit skid 22 and the control house skid 26 are anchored against lateral movement along the flatbed 12 by hold down pins 28 shown in more detail in FIG. 12. The frame of the power skid 22, for example, is equipped with at least one sleeve 30 of rectangular cross section on each side of the skid. The ends of each sleeve 30 are open through holes provided in the skid frame. The skid 22 is positioned on the flatbed 12 so that the sleeve 30 is aligned with a bracket 32 providing a passageway comparable in cross section to that of the sleeve. The pin 28 is inserted through the top of the sleeve 30 to protrude below the bottom of the bracket 32. A laterally extending lip **28*a* prevents the pin 28 from passing completely through the skid frame. A keeper pin 34 is inserted through a hole 28*b* in that portion of the pin 28 which extends below the bracket 32 to prevent inadvertent removal of the pin from the sleeve 30. With at least one such pin 28 provided on each side of skids 22 and 26, the power unit and control house are held securely in place against lateral movement along the flatbed 12. A similar hold down pin arrangement may be provided for the tube reel skid 18**, or this skid may be secured by other appropriate means such as chaining or bolting the skid to the flatbed (not shown).

Tubing 36 used in the well working operation is stored on the reel 16 and is fed through a level wind guide 38 to an injector head 40. The injector head 40 is mounted on a mast shown generally at 42. The mast 42 is mounted on the flatbed 12 by bolting and/or welding.

Details of the mast construction may be appreciated by reference to FIGS. 1–5 and 10. The mast 42 includes a pair of upper mast legs 44 and 46 pivotally mounted on lower mast legs 48 and 50, respectively. The lower mast legs 48 and 50 are each fixed to the flatbed and further braced thereto by beams 52 and 54. Mast components 44 through 54 are generally of I-beam construction. An assembly of crossbeams 56 joins the tops of the upper mast legs 44 and 46 and ensures a rigid, stable mast construction.

Figure 10:
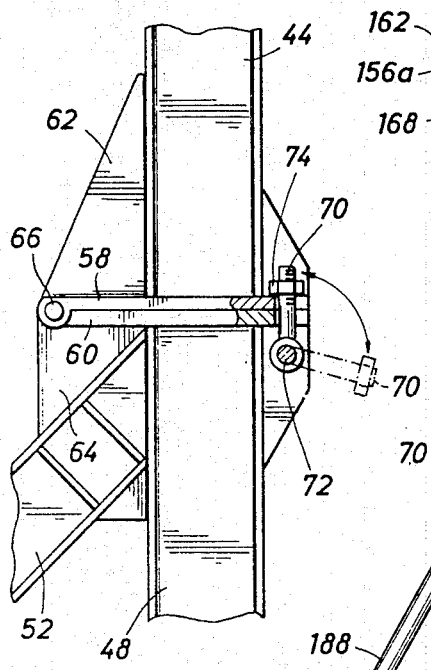
FIG. 10 is a fragmentary view of the mast pivot mechanism.

The manner of pivotally joining the upper mast legs with the respective lower mast legs may be appreciated by reference to FIG. 10. A hinge assembly is constructed to include an upper hinge plate 58 fixed to the bottom of the upper mast leg 44 and a lower hinge plate 60 fixed to the top of the lower mast leg 48. Bracing 62 and 64 is provided for the upper and lower hinge plates, respectively. The two hinge plates 58 and 60 are joined by a hinge pin 66 about which the upper mast leg 44 pivots relative to the lower mast leg 48. A similar hinge assembly is provided whereby the upper mast leg 46 pivots relative to the lower mast leg 50, with the hinge pins of both hinge assemblies generally possessing a common rotational axis. This axis about which the upper mast section pivots is laterally displaced a short distance from the vertical projection of the lower mast legs 48 and 50. However, with the upper mast section erect, the upper mast legs 44 and 46 are placed generally directly above the lower mast legs 48 and 50, respectively, and function as continuations thereof.

The manner in which the mast pivots may be best be appreciated be reference to FIGS. 1 and 2. A pair of fluid pressure piston-cylinder assemblies 68 (only one visible) joins the upper mast legs 44 and 46 to the lower mast leg braces 52 and 54, respectively. Thus, the cylinders 68 are effectively anchored to the flatbed 12. As the pistons are retracted in the cylinder assemblies 68, the upper mast section, including the upper mast legs 44 and 46, is lowered to an essentially horizontal configuration as indicated in FIG. 1. In this posture, the upper mast section is supported by the two hinge pins and by a pair of pads **24*a* located on the top of the control house 24 for receiving the upper mast legs 44 and 46. The pads 24*a* prevents the crossbeams 56 from contacting the roof of the control house 24, leaving sufficient spacing between the house and these beams to permit the tubing 36 to pass through as indicated in FIG. 1**.

Figure 3:
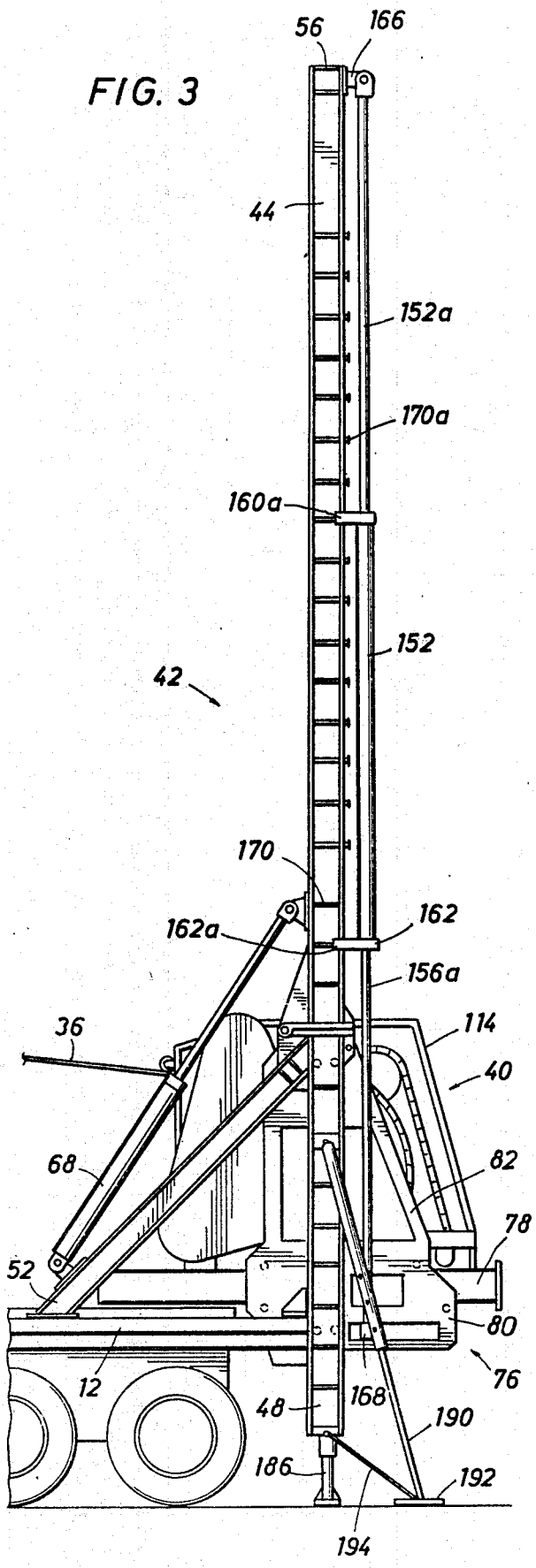
FIG. 3 is an enlarged side elevation of the mast and injector head with the double cylinder elevation assembly engaged with the injector head.
Figure 4:
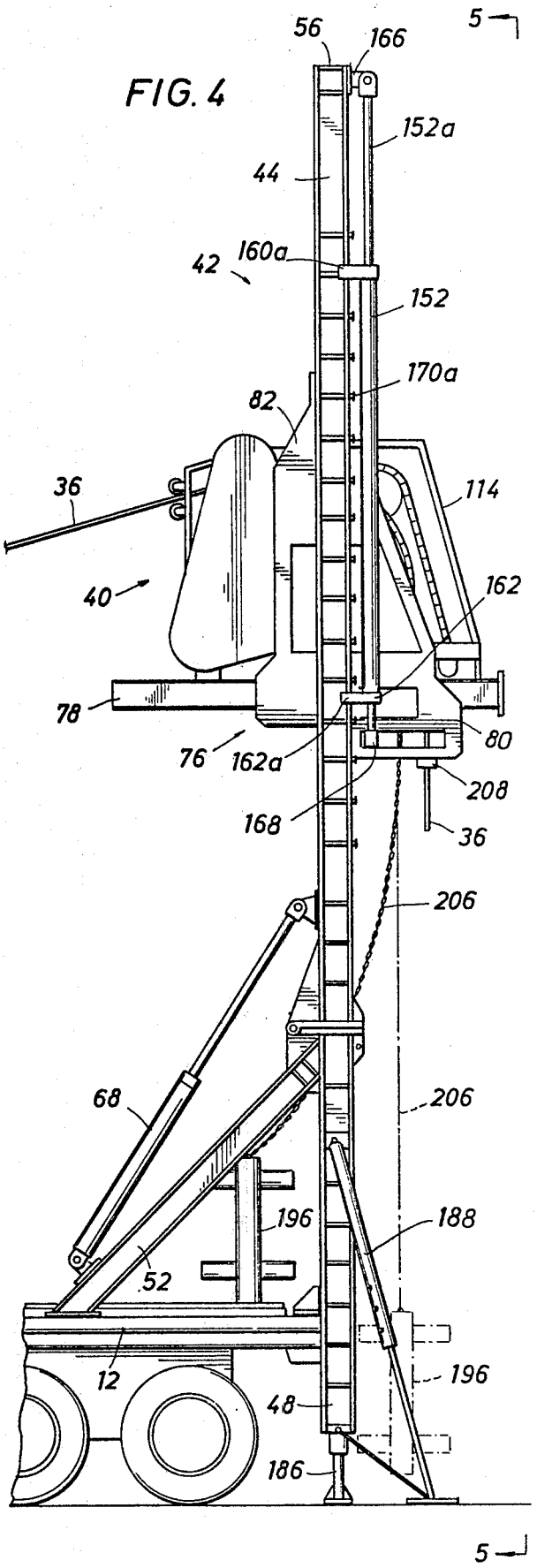
FIG. 4 is a view similar to FIG. 3, showing the injector head elevated along the mast.
Figure 5:
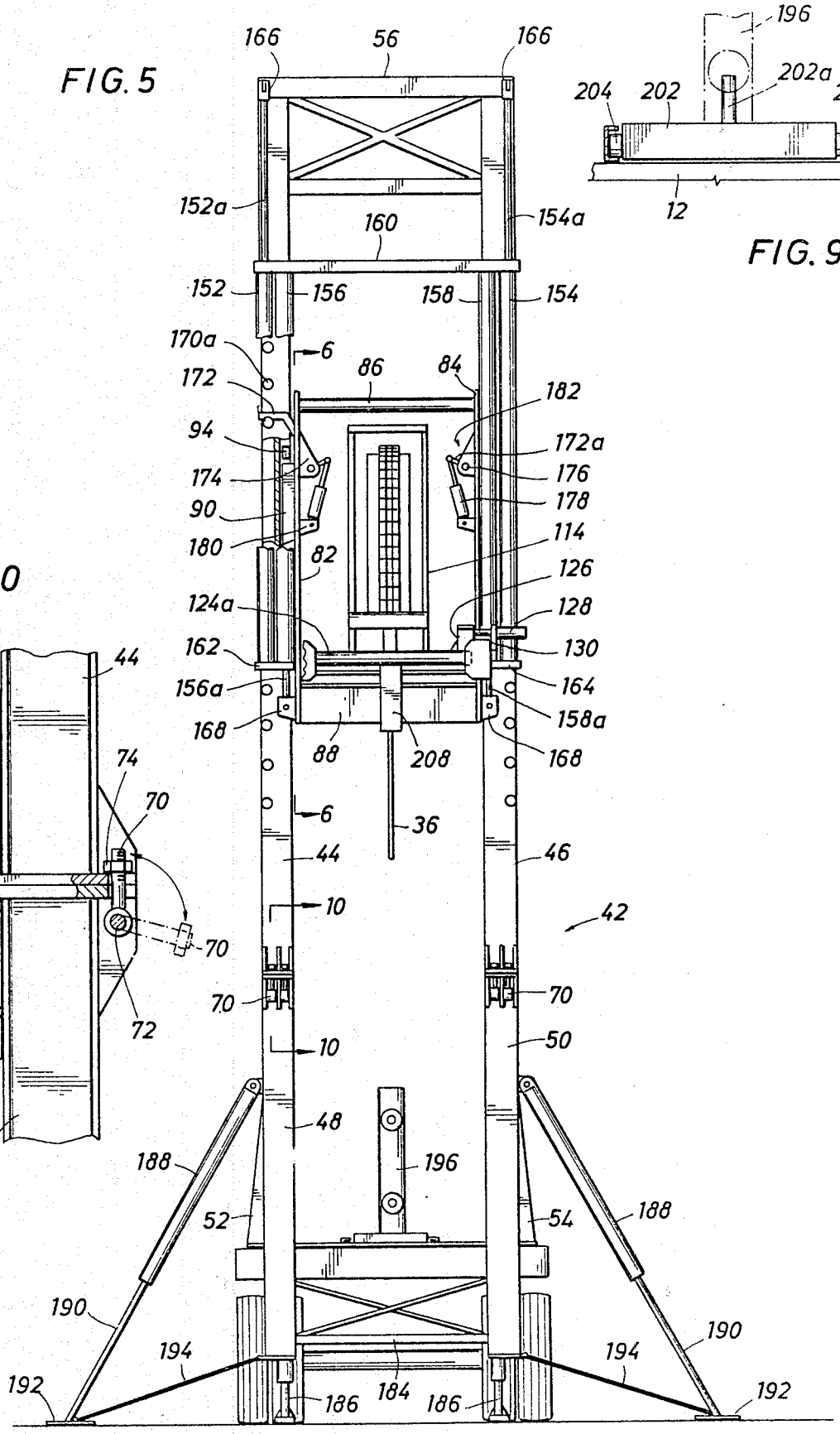
FIG. 5 is an end elevational view along line 5—5 of FIG. 4, partially broken away.

As the piston rod of each cylinder 68 is extended under the influence of applied fluid pressure, the upper mast section pivots about the hinge pins as indicated by the arrow in FIG. 2. Ultimately, the upright configuration of FIGS. 2–5 is achieved wherein the upper mast legs 44 and 46 are aligned with, and resting on, the lower mast legs 48 and 50, respectively. With the upper and lower hinge plates 58 and 60 closed on each other in this upright mast configuration, a pair of swing bolts and nuts are positioned and tightened across the hinge plates of each of the two mast leg structures. As illustrated in FIGS. 5 and 10, each of the swing bolts 70 is pivotally anchored, by means of a pin 72, to the respective lower mast leg 48 or 50. The hinge plates 58 and 60 are equipped with slots to receive the swing bolts 70. With the bolts 70 thus positioned, associated nuts 74 are tightened against the upper hinge plates. The four swing bolts 70 and nuts 74 thus anchor the upper mast legs 44 and 46 to the corresponding lower mast legs 48 and 50, respectively, to maintain the upper mast section in the erect configuration.

The injector head 40 is carried by a carriage structure shown generally at 76. Details of the carriage structure may be more fully appreciated by reference to FIGS. 3–8. The carriage structure at 76 includes a horizontal carriage platform 78 and a vertical carrier assembly 80. The vertical carrier assembly 80 includes side panels 82 and 84 joined at the top by a crossmember 86 and at the bottom by a beam construction 88. A pair of channel beams 90 and 92 ride within the mast legs 44, 48 and 46, 50, respectively. The channel beams 90 and 92 are fixed on the outer surfaces of the side panels 82 and 84, respectively, and bear the left-right lateral load between the vertical carrier assembly and the mast. A pair of rollers 94 are mounted on each of the side panels 82 and 84 just beyond the upper and lower ends of each of the guides 90 and 92. The rollers 94 bear the lateral load in the forward and backward direction between the vertical carrier assembly and the corresponding mast legs. The combination of the channel beams 90 and 92 and the rollers 94 serve to guide the vertical carrier assembly 80 along the mast legs.

The horizontal carriage platform 78 features a base plate 96 and a pair of longitudinally extending side arms 98 and 100 whose cross sections resemble that of a channel beam. A plate 102 connects the back end of the side arms 98 and 100, and each of these arms is subtended at the front end by a cover plate 104.

The side arms 98 and 100 ride between upper and lower sets of rollers 106 and 108, respectively, mounted on the interior of both side plates 82 and 84. Additionally, upper and lower rails 110 and 112, respectively, are fixed to each of the side panels 82 and 84 to further constrain vertical movement of the horizontal carriage platform relative to the vertical carrier assembly.

Figure 6:
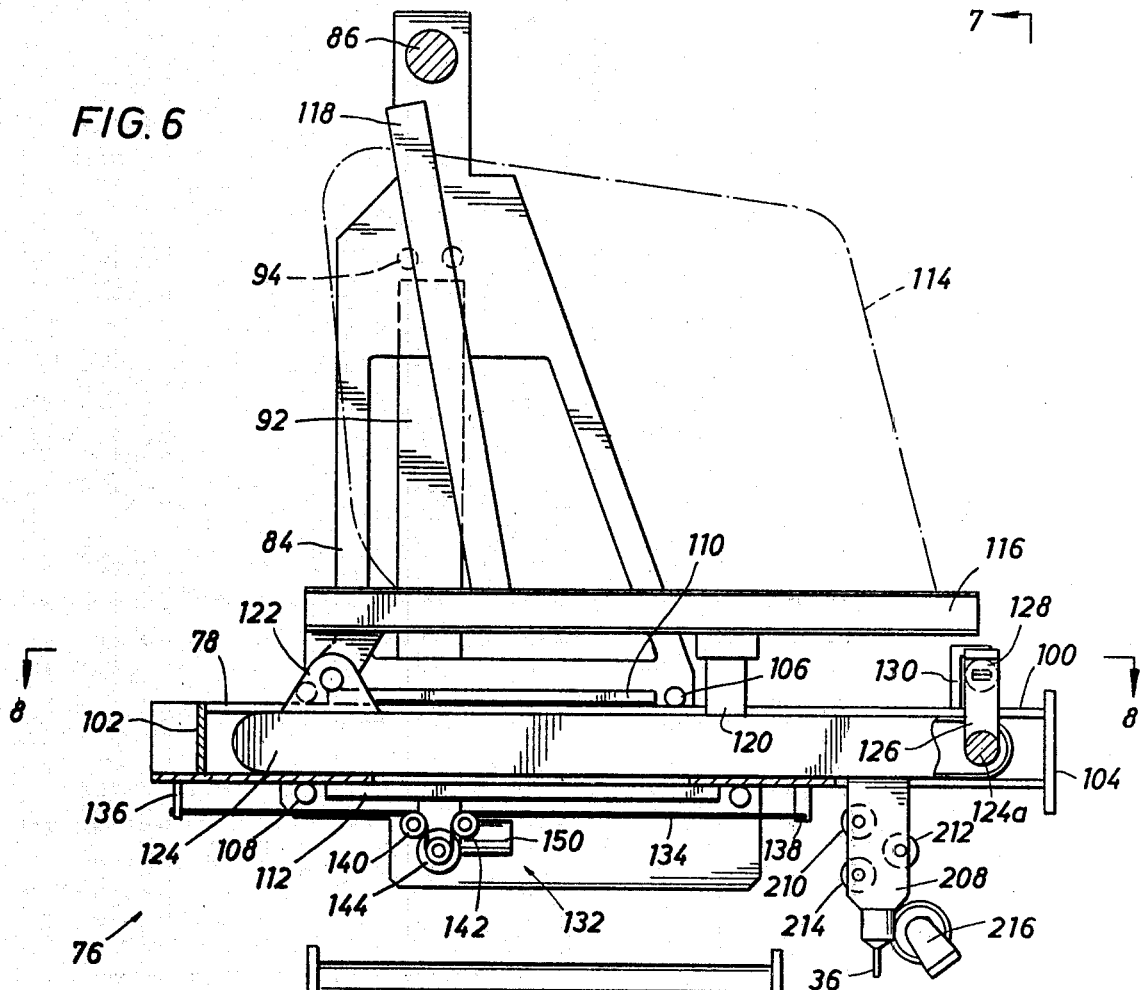
FIG. 6 is a cross-sectional view of the injector head framing and carriage structure along line 6—6 in FIG. 5, but with details of the injector head removed for clarity.

Tubing injector heads such as the one indicated at 40 are well known in the art, and will not be described in detail herein. It should be noted, however, that the basic elements of such an injector head, including the chain dog assemblies, the motor and gear mechanisms and the chain tensioner mechanism, may be mounted within a framework 114. Further framing including horizontal members 116 and members 118 provide additional support for mounting the various injector head components. As best seen in FIG. 6, the horizontal members 116 are joined by a support post 120 and a pivot union 122 to a skid base 124. The skid base fits within the area defined by the platform side arms 98 and 100, the back plate 102, and the cover plates 104 of the horizontal carriage. As may be appreciated from FIGS. 6–8, the skid base 124 is inserted within the side arms 98 and 100 before the end plates 104 are bolted into position. Further, the skid base 124 is capable of a moderate amount of lateral movement relative to the horizontal carriage platform in forward and backward as well as sideways directions.

A bracket 126 extends upwardly from a front cross bar 124*a* of the skid base and is coupled to the piston rod of a fluid pressure piston-cylinder assembly 128 whose cylinder is fixed by a bracket 130 to the side arm 100 of the horizontal carriage platform. Operation of the piston-cylinder assembly 128 by application of fluid pressure thereto causes the skid base 124 to move to the right or left relative to the horizontal carriage platform as the piston rod of the cylinder is extended or retracted, respectively. In this fashion, the injector head mounted on the skid base 124 is provided a degree of freedom in a generally horizontal direction transverse to the direction of folding of the mast 42.

Figure 7:
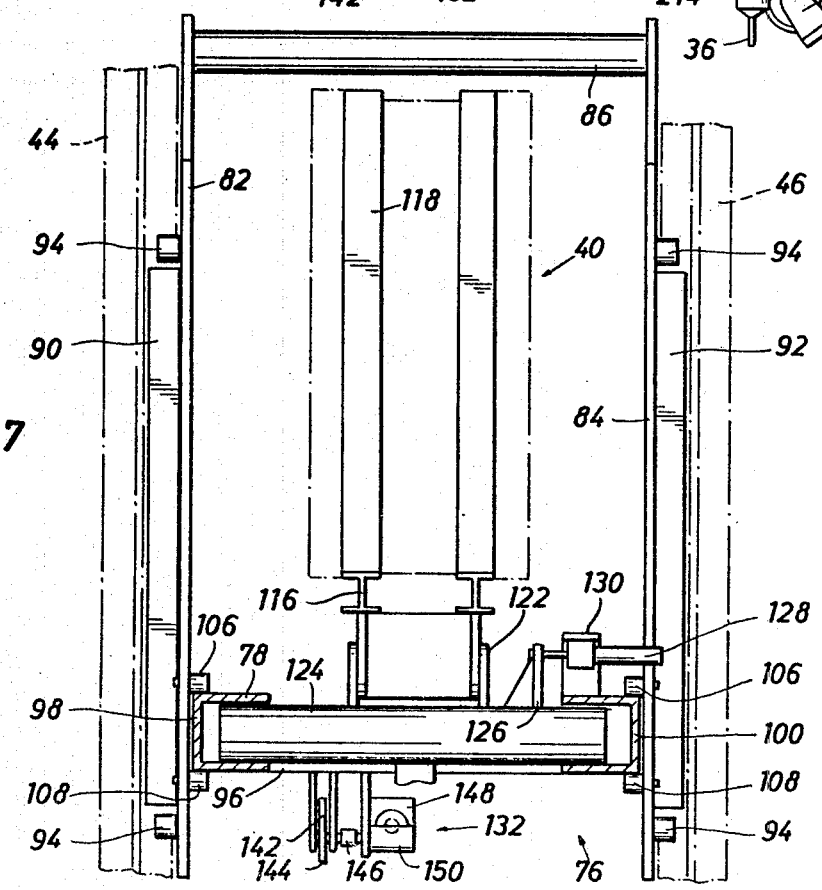
FIG. 7 is a cross-sectional view taken along line 7—7 of FIG. 6.
Figure 8:
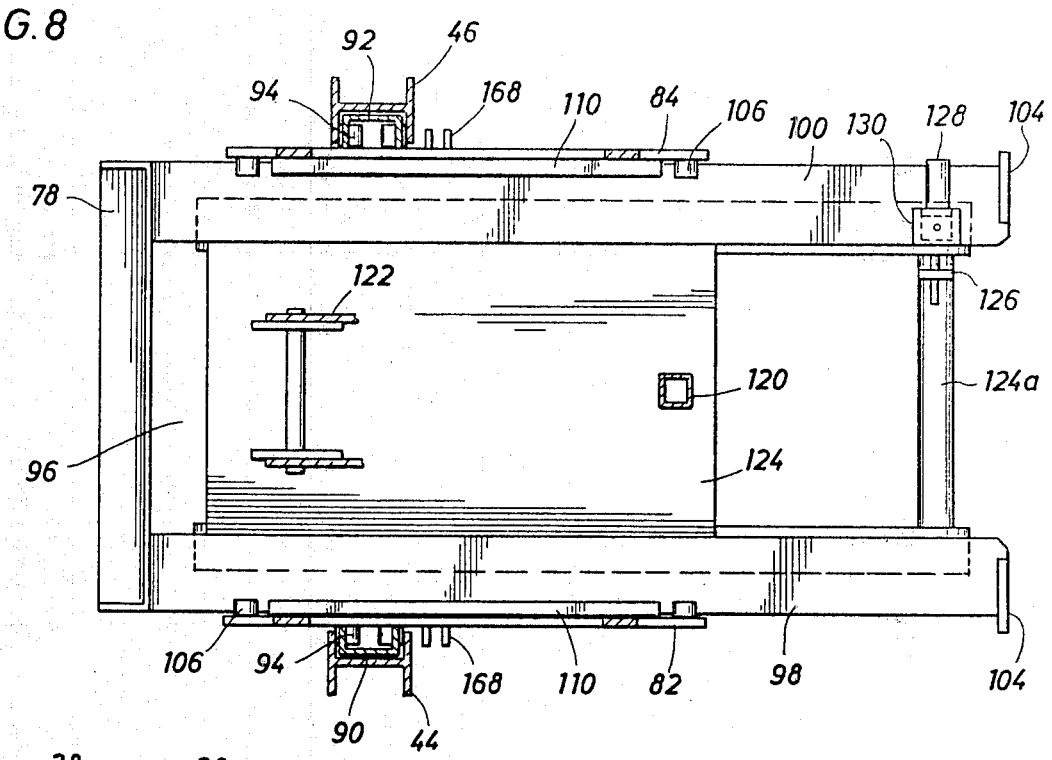
FIG. 8 is a cross-sectional view taken along line 8—8 of FIG. 6.

As illustrated in FIGS. 6 and 7, the horizontal carriage platform 78, with the skid base 124 and the injector head 40 mounted thereon, may be moved forward and backward parallel to the direction of folding of the mast 42 by means of a chain drive assembly shown generally at 132. A pair of chains 134 is anchored to the bottom of the horizontal carriage platform at points 136 and 138, and pass around a pair of idler sprockets 140 and 142 and a drive sprocket 144 between and below the idler sprockets. The shaft of the drive sprocket is coupled at 146 to a worm drive 148 which, in turn, is joined to a reversable motor 150. Operation of the motor in one rotational sense or the other causes the drive sprocket 144 to be driven through the worm drive 148 in one rotational sense or the other to move the chain forward or backward, respectively, around the drive sprocket and the idler sprockets 140 and 142. Consequently, the horizontal carriage platform 78, and, therefore, the injector head 40, are caused to move forward or backward in response to such operation of the motor 150. In this fashion, the injector head 40 is provided a degree of freedom in a generally horizontal direction along the direction in which the mast 42 is pivoted. Further, the use of the worm drive 148 provides a positive locking mechanism wherein the horizontal carriage platform 78 is maintained in the relative horizontal position in which it is located upon cessation of operation of the motor 150. This is true because any tendency for the horizontal carriage platform 78 to be moved without operation of the motor 150 causes the chain to move through, and rotate, the sprockets 140 through 144 with the result that the worm drive 148 must also be turned. Since such backward driving of the worm drive 148 through the coupling 146 is met with considerable resistance by the worm drive itself, the horizontal carriage assembly 78 is positively locked into position without operation of the motor 150.

The mast at 42 is equipped with a double cylinder pickup system including outer cylinders 152 and 154 and inner cylinders 156 and 158, as best seen in FIG. 5. The tops of the cylinders 152 through 158 are joined by a crossmember 160 which features wrap-around ends 160*a* which ride along the I-beam flanges of the upper mast legs 44 and 46. The lower ends of cylinders 152 and 156 are joined by an end plate 162 with a wrap-around extension 162*a* which also rides along the I-beam construction of upper mast leg 44. Similarly, the bottom ends of the cylinders 154 and 158 are joined by an end plate 164 with a wrap-around extension (not visible) which rides along the I-beam construction of the upper mast leg 46. The "gripping" of the members 160 through 164 of the upper mast legs 44 and 46 serves to guide the cylinders 152 through 158 along the upper mast section and prevent any separation of the cylinder system from the mast.

The outer cylinder assemblies 152 and 154 feature upwardly directed piston rods 152*a* and 154*a*, respectively, which are coupled to the top of the mast at brackets 166. The inner cylinders 156 and 158 feature downwardly directed piston rods 156*a* and 158*a*, respectively. These latter piston rods 156*a* and 158*a* may be extended downwardly and connected by pins to clevises 168 mounted on the side panels 82 and 84, respectively, of the vertical carrier assembly 80. Then, as the fluid pressure is selectively applied to the cylinder assemblies 152 through 158, the vertical carrier assembly 80 may be raised or lowered along the erect mast 42. Consequently, a third degree of motion is provided for the injector head 40 in a vertical direction along the mast.

The outer channel of each of the I-beam mast legs 44 through 50 is fitted with a series of rods 170 which function as ladder steps along the mast. The rods 170 along the upper mast legs 44 and 46 are for the most part of heavy duty design, as indicated in FIGS. 3 and 4 by their increased thickness, and protrude beyond the front surfaces of the upper mast legs in the form of studs with upset ends 170*a*. As shown in FIG. 5, a latch arm 172 is pivotally connected by a bracket 174 and pin 176 to the side panel 82 of the vertical carrier assembly 80. A wing 172*a* extends laterally from the latch arm and is joined to a fluid pressure piston-cylinder assembly 178 which is flexibly anchored to the side panel 82 by a bracket 180. As fluid pressure is appropriately applied to the piston-cylinder 178, the piston rod may be extended to swing the latch arm 172 over a stud 170*a* to thereby anchor the vertical carrier 80, and the injector head 40, against downward movement relative to the mast 42. With the piston of the cylinder assembly 178 contracted, the latch arm 172 is rotated clockwise, as viewed in FIG. 5, in an arc away from the studs 170*a*. With the latch arm 172 thus disengaged from the studs 170*a*, the vertical carrier assembly 80 may be raised or lowered as desired by operation of the cylinder assemblies 152 through 158. A similar pivoted latch arm, operated by a piston-cylinder assembly, is indicated at 182 mounted on the other side panel 84 of the vertical carrier assembly 80 to selectively engage or disengage studs 170*a* along the other upper mast leg 46. The two latch arms may be operated simultaneously by linking the fluid pressure lines leading to the corresponding piston-cylinder assemblies. Thus, in addition to the piston-cylinder assemblies 152 through 158 maintaining the vertical carrier assembly 80 and the injector head 40 at a selected elevation by appropriate application of fluid pressure to these cylinders, the latch arms are available for preventing downward movement of the vertical carrier assembly and injector head in the event of a failure in the cylinders 152 through 158, or in the fluid pressure lines leading thereto.

The lower mast legs 48 and 50 are joined together below the flatbed 12 by a crossbeam assembly 184. Screw jacks 186 carried at the base of each of the lower mast legs 48 and 50 may be extended downwardly to engage the ground prior to the elevation of the upper mast section. Thus, with the coiled tubing assembly in position to operate on a well, a significant portion of the weight of the mast 42 and the injector head 40 may be supported directly on the ground through the screw jacks 186.

An outrigger 188 is also carried by each of the lower mast legs 48 and 50, and includes a leg 190 telescoped within the outrigger sleeve and ending in a footpad 192. The leg 190 may be extended and pinned to the outer sleeve so that the footpad 192 may be placed firmly on the ground with the entire outrigger 188 oriented at an angle of, say, 45° relative to the vertical. The leg 190 is then secured at this position by a chain or cable 194 leading to the base of the associated lower mast leg. When the coiled tubing assembly of the present invention is in a transportation configuration as indicated in FIG. 1, with the mast folded, the legs 190 are retracted and the outriggers 188 are folded against the corresponding lower mast legs. Similarly, the screw jacks 186 are retracted within the inner channels of the lower mast leg I-beams.

Figure 9:
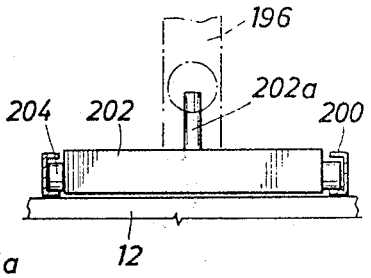
FIG. 9 is a cross-sectional view taken along line 9—9 of FIG. 1, illustrating the blowout preventer carriage and track system.

A blowout preventer 196 is provided for use on the Christmas tree of the well on which the coiled tubing assembly is to operate. A pair of channel beams 200 (FIG. 9) are welded to the flatbed 12 between the position of the control house 24 and the anchoring of the mast 42. These channel beams 200 form a track system along which a blowout preventer carriage 202 may ride on rollers 204. The blowout preventer 196 may be carried on the carriage 202 and fastened there by any appropriate means, such as, for example, setting the blowout preventer on an upright stud 202*a* provided on the carriage for that purpose. For transportation and storage purposes the blowout preventer carriage 202, with the blowout preventer 196 positioned thereon, is moved toward the control house 24. In this position, the blowout preventer 196 does not interfere with the lowering of the injector head 40 so that the mast 42 may be folded, as indicated in FIG. 1. With the mast 42 erect and the injector head 40 elevated, the blowout preventer may be moved forward by advancing the carriage 202 along the track system of the channel beams 200 until the blowout preventer is positioned generally under the elevated injector head. A cable or chain 206 may be used to join the blowout preventer to the bottom of the skid base 124 as indicated in FIG. 4. The blowout preventer 196 may then be swung forward until it is in position over the Christmas tree of the well, (not shown), as indicated by the phantom lines in FIG. 4. In this fashion, the combination of the vertical carrier assembly 80 and the horizontal carriage platform 78, both supported on the mast 42, serves as a crane to allow the blowout preventer 196 to be swung into position over the well from the flatbed 12. When the well operation is completed, the cable or chain 206 may be used to reconnect the blowout preventer 196 to the skid base 124 to allow the blowout preventer to be swung back onto the carriage 202 for ultimate movement back into the storage or transportation configuration toward the control house 24, as indicated in FIG. 1.

The skid base 124 is fitted with a tube straightener 208 illustrated in detail in FIG. 6. The tube straightener 208 includes a pipe guide composed of three free wheeling rollers 210, 212, and 214 arranged in a plane with parallel rotational axes, as indicated in FIG. 6. The tubing 36 is received by the injector head 40 and passed along the chain dogs (not shown in detail) and down through the tube straightener 208. Within the tube straightener 208, the tubing 36 passes on the forward side of the rear wheels 210 and 214, and to the rearward side of the front wheel 212. The forward-backward lateral displacement of the forward wheel 212 relative to the other two wheels 210 and 214 is such that the tubing 36 is given a slight forward concave curvature to compensate for the opposite curvature enforced therein by passage through the injector head 40. Consequently, the tubing 36 emerging from the bottom of the tube straightener 208 is essentially straight.

A tubing meter 216 is provided at the vicinity of the tube straightener 208 to measure the length of tubing 36 injected into, or extracted from, the well being worked. It is particularly advantageous to place the tubing meter 216 between the injector head 40 and the well so that whatever stretching may have been effected on the tubing as it was driven downwardly by the injector head 40 will have occured prior to the measurement of the tubing length. Consequently, a relatively more accurate reading of the amount of tubing 36 actually injected into the well may be obtained.

Figure 11:
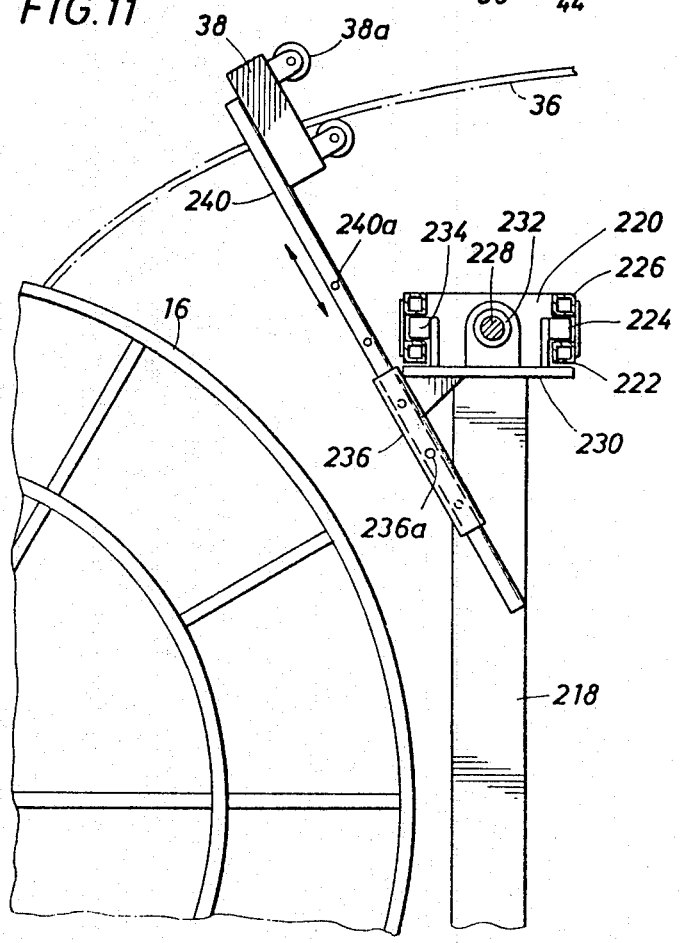
FIG. 11 is a fragmentary view, in cross section, of the level wind mechanism illustrating the height variation capability.

The level wind tubing guide 38 fitted on the coiled tubing reel 16 is shown in some detail in FIG. 11. Vertical framing 218 supports a pair of end plates 220 (only one shown). A pair of lower rails 222, constructed of tubing of square cross-section and extending between the end plates 220, is joined by spacers 224 to matching upper rails 226 also extending between the end plates. A multi-return cylinder 228 is supported at the end plates 220 by appropriate bearing assemblies (not shown). A guide carriage 230, equipped with a floating nut 232 encompassing the cylinder 228, is constrained to lateral movement by bearings 234 mounted on the carriage and riding between the rails 222 and 226. Extending from the carriage 230 is a pair of sleeves 236 (only one visible). Each of the sleeves 236 receives a leg 240 which is slidable within the corresponding sleeve as indicated by the arrow. The legs 240 may be set at a desired height by pinning the legs to the respective sleeves 236 through holes 240*a* in the legs aligned with holes 236*a* in the sleeves. The tubing guide 38 is fixed to the top end of the legs 240 and moves up and down with the legs as the latter are moved along the sleeves 236. Thus, the guide 38 may be positioned at a variety of heights as desired for convenience of operation, as illustrated in FIG. 2, or lower to achieve a low profile for road clearance, as shown in FIG. 1. The guide 38 is of standard design including rollers 38*a* against which the tubing 36 may bear in the vertical direction as well as additional rollers (not visible) against which the tubing may bear in the transverse direction.

The tubing reel assembly 16 is equipped with a motor drive and appropriate gear or chain linkages (not shown) in a conventional manner. Thus, the motor of the reel assembly 16 may be selectively operated to rotate the reel to take up the tubing 36 as it is extracted from the well. Additionally, a drag effect may be produced by operating the motor of the reel assembly 16 to resist the unwinding of the tubing 36 from the reel as the tubing is being injected into the well. This drag-producing operation may be used to maintain a desired amount of tension in the tubing between the reel and the injector head 40 as well as to prevent the reel from running free and unwinding the tubing at a rate greater than desired.

The motor of the reel assembly 16 is also connected by appropriate belts or chains (not shown) to the multi-return cylinder 228 to rotate this cylinder whenever the reel itself is being rotated. Thus, when the reel, for example, is being rotated to take up the tubing 36, the cylinder 228 is continuously rotated in one rotational sense thereby causing back and forth lateral motion of the carriage 230 due to the meshing of the floating nut 232 mounted thereon with the helical grooves of the cylinder. As the carriage is thus swept back and forth, the tubing guide 38 is also maneuvered back and forth relative to the reel and guides the tubing 36 accordingly. Thus, in a well known manner, the tubing 36 is wound in a level fashion on the reel 16. When the tubing 36 is being removed from the reel, rotation of the reel is accompanied by rotation of the multi-return cylinder 228 due to the linkage of the cylinder to the motor, and to the reel 16. Consequently, the carriage 230 and the tubing guide 38 are again swept back and forth across the face of the reel 16 to facilitate the removal of the tubing therefrom.

The reel assembly 16 is fitted with a fluid-seal swivel device 242 incorporated in the hub of the reel in a well known manner. With one end of the tubing 36 extending down the well, the opposite end of the tubing fixed relative to the reel drum may be secured to one end of the swivel device 242 which rotates with the reel. Then, with the tubing 36 in the well, fluids of various kinds may be introduced down the well through the tubing 36 by means of the swivel device 242.

The fluid pressure lines from the power unit 20 and the control house to the reel drive motor and the various fluid pressure devices on the mast 42 and injector head 40 have not been expressly included in the drawings for purposes of clarity. Such fluid pressure communication lines are generally conventional. However, the fluid pressure lines used in the present system may be fitted with counterbalance valves. Such counterbalance valves are known, but not heretofore employed in coiled tubing systems. The counterbalance valves function to prevent rapid loss in pressure in a cylinder when a leak or break has occured in the associated pressure line. Thus, a safety factor is added to prevent, say, dropping of the injector head, or collapsing of the mast, when such a leak or break occurs.

When the coiled tubing assembly as described herein is brought to a well to be worked, it may be generally in the configuration illustrated in FIG. 1. Thus, the injector head 40 is in its lowermost position with the mast folded. The tubing 36 may or may not be extended through the guide 38 and the injector head 40 to the tube straightener 208. In either case, the tubing guide 38 would most likely be in a retracted configuration as shown to provide necessary road clearance for transportation.

The truck 14 is maneuvered to back the flatbed 12 to the vicinity of the well. The outriggers 188 are positioned as described hereinbefore and the screw jacks 186 are lowered against the ground. With the engine of the power unit 20 operating, the hydraulic pump and pneumatic compressor are operable. The air compressor is generally utilized to operate the chain tensioner (not shown) which is part of the injector head.

Hydraulic pressure is applied to the cylinder assemblies 68 to raise the mast to its vertical operating configuration. The four swing bolts 70 are positioned and locked. The double cylinder pickup system is then lowered by extension of the outer piston rods 152*a* and 154*a*, and the two inner piston rods 156*a* and 158*a* are lowered and pinned to the clevises 168 of the vertical carrier assembly 80. The cylinders 152 through 158 are further operated to elevate the injector head 40 along the mast 42.

The blowout preventer 196 is then moved forward on its carriage 202 to a position under the elevated injector head 40 as indicated in FIG. 4. The cable or chain 206 is used to connect the blowout preventer 196 to the injector head skid base 124 and the vertical carrier assembly 80 is further elevated. With the blowout preventer suspended from the skid base 124, the blowout preventer carriage 202 is returned to its transportation position toward the control house 24. The chain drive 132 is then operated to move the injector head 40 forward until the tubing straightener 208 is directly over the well. If necessary, the left-right adjustment cylinder 128 may be operated to move the front end of the skid base 124 and, therefore, the injector head 40 and the associated tubing straightener 208 laterally to position the tubing straightener over the well. The blowout preventer 196 is fastened to the top of the well Christmas tree and disengaged from the skid base 124.

The level of the injector head may again be adjusted, if necessary. When finally set at the desired operating position, the vertical carrier assembly is secured to the mast by the latch arms 172 engaging the studs 170*a*.

The level wind tubing guide 38 is raised to a more convenient operating position as indicated in FIG. 2, and the tubing 36 is advanced by operation of the injector head 40 through the tube straightener 208 down through the blowout preventer 196 into the well. If necessary, the tubing is first extended from the reel 16 through the tubing guide 38 and the injector head 40 to the tubing straightener 208.

Continued operation of the injector head 40 forces more of the tubing down the well. During this procedure, the tubing meter 216 maintains a constant reading on the amount of tubing 36 that has been injected into the well. Also, the motor of the reel assembly 16 may be so operated as to properly tension the tubing leading into the injector head 40.

When the tubing end is positioned at the desired level in the well, necessary operations may be carried out through the tubing 36 by means of the swivel device 242. For example, liquids may be introduced into the well through the tubing 36 to pump mud or sand from the well. Also, pressurized gasses such as nitrogen may be injected into the well in the workover operation.

When the workover operation has been completed, the injector head 40 may be operated in the opposite direction to extract the tubing 36 from the well as the reel 16 is rotated by its own drive motor to take up the tubing onto the reel. Once the tubing 36 is clear of the blowout preventer 196, it need not be completely wound on the reel, but may be left extending through the injector head 40 and the tube straightener 208. At that point, the blowout preventer 196 may be again connected to the skid base 124 by the cable or chain 206 and raised off of the Christmas tree. The chain drive assembly 132 and, if necessary, the left-right adjustment cylinder 128 are operated to return the horizontal carriage assembly 78 and the injector head 40, with the blowout preventer 196 suspended therefrom, to the original lateral position indicated generally in FIG. 4. The carriage 202 is moved under the injector 40 and the blowout preventer 196 is positioned on the carriage and disconnected from the skid base 124. The blowout preventer and its carriage are then returned to their transportation position. The latch arms 172 are disengaged from the studs 170*a* and the vertical carrier assembly 80 is lowered to the flatbed 12 as shown in FIG. 3.

The inner piston rods 156*a* and 158*a* are disengaged from the clevis connectors 168 and the four piston rods 152*a* through 158*a* are contracted to return the four cylinders 152 through 158 to the top of the mast as indicated in FIG. 2. The four swing bolts 70 are loosened and swung free of the upper hinge plates 58 and the cylinders 68 are operated to lower the mast to its transportation configuration as indicated in FIG. 1.

The tubing guide 38 is lowered by allowing the legs 240 to pass through the sleeves 236 to a lower position, with the tubing 36 still passing through the guide 38 to the injector head 40 and the tubing straightener 208. The screw jacks 186 are raised into the lower mast legs 44 and 46, and the outriggers collapsed and returned to their travel positions against the lower mast legs as well. The coiled tubing assembly is then ready to be moved to the next well working operation.

It will be appreciated that the present system provides for a coiled tubing apparatus that is relatively convenient and safe to use in well working operations. The capability of lowering the injector head to the flatbed, particularly in an upright configuration, provides increased access for servicing the injector head in a safer and more convenient manner. Furthermore, the ability to fold the mast for transportation purposes without the great weight of the injector head and the associated carriage structure being suspended on the pivoted portion of the mast makes folding the mast and transporting the apparatus safer procedures. The double cylinder system of the present invention allows the cylinders to be effectively extended along the mast above the flatbed as well as to remove the cylinder assembly from the lower portion of the mast for folding purposes. Further, the double cylinder system provides greater latitude in varying the elevation of the injector head along the mast. The chain drive assembly for lateral movement of the injector head horizontal carriage platform, including the worm drive locking mechanism, allows the injector head to be moved forward and backward with relative ease. Further, the left-right adjustment cylinder enhances the degree of flexibility of movement of the injector head over the well. The blowout preventer carriage and track system further allow operations associated with the workover of wells to be carried out with greater ease and safety since the blowout preventer may now be moved along the flatbed and suspended from the elevated injector head to be positioned over the Christmas tree with little or no manhandling. Also, the height adjustment of the level wind tubing guide allows the tubing guide to be lowered for road clearance purposes while retaining the tubing intact therein and extended through to the injector head. Thus, less time is required in setting up the coiled tubing apparatus for workover operations as well as in placing the apparatus in condition for transporting on a highway.

The foregoing disclosure and description of the invention is illustrative and explanatory thereof, and various changes in the size, shape and materials, as well as in the details of the illustrated construction may be made within the scope of the appended claims without departing from the spirit of the invention.

I claim:

1. A suspension system for use with mast means of the type used for elevating the injector head of a well working coiled tubing apparatus, the mast means having two mast legs, comprising:

(a) first and second piston-and-cylinder assemblies with the respective first and second pistons thereof anchored, by portions of said pistons distal the corresponding piston heads thereof, at a suspension located along said mast means, and with the respective first and second cylinders thereof oriented generally mutually parallel, such that simultaneous, in-phase operation of said first and second assemblies to extend said first and second pistons effects generally simultaneous movement of said first and second cylinders generally away from said suspension location, and such operation to retract said first and second pistons effects generally simultaneous movement of said first and second cylinders generally toward said suspension location;

(b) third and fourth piston-and-cylinder assemblies with the respective third and fourth cylinders thereof oriented generally mutually parallel and generally parallel to said first and second cylinders, said third and fourth pistons of said third and fourth assemblies, respectively, being extendable along mutually parallel lines and in the same sense, but opposite to the sense in which said first and second pistons are extendable from said first and second cylinders, respectively;

(c) wherein said first and third cylinders are mutually fixed to form a first cylinder pair, said second and fourth cylinders are mutually fixed to form a second cylinder pair, and first and second cylinder pairs are connected together by connection means, and said first and second pairs are moveable together by operation of said first and second assemblies; and and wherein said first piston is anchored so that said first cylinder pair is moveable generally along one such mast leg, and said second piston is anchored so that said second cylinder pair is moveable generally along the other of said mast legs.

2. A suspension system for use with mast means of the type used for elevating the injector head of a well working coiled tubing apparatus, the mast means having two mast legs, comprising:

(a) first and second piston-and-cylinder assemblies with the respective first and second pistons thereof anchored, by portions of said pistons distal the corresponding piston heads thereof, at a suspension location along said mast means, and with the respective first and second cylinders thereof oriented generally mutually parallel, such that simultaneous, in-phase operation of said first and second assemblies to extend said first and second pistons effects generally simultaneous movement of said first and second cylinders generally away from said suspension location, and such operation to retract said first and second pistons effects generally simultaneous movement of said first and second cylinders generally toward said suspension location;

(b) third and fourth piston-and-cylinder assemblies with the respective third and fourth cylinders thereof oriented generally mutually parallel and generally parallel to said first and second cylinders, said third and fourth pistons of said third and fourth assemblies, respectively, being extendable along mutually parallel lines and in the same sense, but opposite to the sense in which said first and second pistons are extendable from said first and second cylinders, respectively;

(c) wherein said first and third cylinders are mutually fixed to form a first cylinder pair, said second and fourth cylinders are mutually fixed to form a second cylinder pair, and first and second cylinder pairs are connected together by connection means, and said first and second pairs are moveable together by operation of said first and second assemblies;

(d) said first piston being anchored so that said first cylinder pair is moveable generally along one such mast leg, and said second piston is anchored so that said second cylinder pair is moveable generally along the other of said mast legs;

(e) said mast means including an upper portion and a lower portion, said upper and lower portions being joined by hinge means so that said upper portion is moveable about said hinge means between a folded configuration and a second configuration in which said upper portion is generally aligned with said lower portion;

(f) said suspension location being along said upper portion of said mast means and said first and second pistons being oriented generally along said upper portion of said mast means between said suspension location and a second location toward said hinge means;

(g) whereby said first and second cylinders may be positioned generally along said upper portion of said mast means between said suspension location and said hinge means by retraction of said first and second pistons; and (h) whereby with said upper portion of said mast means in said second configuration, said third and fourth pistons may be extended to reach along said lower portion of said mast means.

* * * * *